US007331107B2

(12) United States Patent
Follo et al.

(10) Patent No.: US 7,331,107 B2
(45) Date of Patent: Feb. 19, 2008

(54) PIVOT AXIS FOR A SHAVING CARTRIDGE

(75) Inventors: Thomas A. Follo, Milford, CT (US); Andrew T. Hitchcock, West Haven, CT (US); Paul D. Richard, Shelton, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 11/314,703

(22) Filed: Dec. 20, 2005

(65) Prior Publication Data

US 2007/0137045 A1 Jun. 21, 2007

(51) Int. Cl.
*B26B 21/22* (2006.01)

(52) U.S. Cl. ..... 30/50; 30/527

(58) Field of Classification Search ..... 30/50, 30/527, 528, 529, 530, 531, 532, 533
See application file for complete search history.

(56) References Cited

U.S. PATENT DOCUMENTS

| | | | | |
|---|---|---|---|---|
| 3,724,070 | A | 4/1973 | Dorion, Jr. | |
| 4,275,498 | A | 6/1981 | Ciaffone | |
| 4,492,024 | A | 1/1985 | Jacobson | |
| 4,756,082 | A * | 7/1988 | Apprille, Jr. | 30/530 |
| 4,852,254 | A * | 8/1989 | Duncan | 30/50 |
| 4,970,784 | A | 11/1990 | Althaus et al. | |
| 5,141,694 | A | 8/1992 | Butlin et al. | |
| 5,481,802 | A | 1/1996 | Lembke | |
| 5,661,907 | A | 9/1997 | Apprille, Jr. | |
| 6,612,040 | B2 | 9/2003 | Gilder | |
| 2004/0221455 | A1 | 11/2004 | Coffin | |
| 2004/0255467 | A1 | 12/2004 | Lembke et al. | |
| 2006/0277759 | A1* | 12/2006 | Follo | 30/50 |

FOREIGN PATENT DOCUMENTS

| | | | |
|---|---|---|---|
| DE | 29706022 | U1 | 5/1997 |
| EP | 1586425 | A | 10/2005 |
| GB | 1460732 | | 1/1977 |
| WO | WO 2005/108024 | A | 11/2005 |

* cited by examiner

*Primary Examiner*—Hwei-Siu C. Payer
(74) *Attorney, Agent, or Firm*—Michaud-Duffy Group LLP

(57) ABSTRACT

A safety razor is provided comprising a razor cartridge mounted on pivoting connecting structure of a handle. The razor cartridge has four or more razor blades. The pivot axis of the razor cartridge is rearward of the midpoint of the cartridge width and below a plane tangent to the guard and cap structures of the housing of the razor cartridge.

21 Claims, 4 Drawing Sheets

PIVOT AXIS FOR A SHAVING CARTRIDGE

BACKGROUND OF THE INVENTION

1. Technical Field

This invention relates generally to shaving devices, and more specifically to razor cartridges having a pivotal connection to handles of safety razors.

2. Background Information

In recognition that skin surfaces to be shaved are not planar, many modern shaving implements, also commonly known as wet shave or safety razors, include a disposable razor cartridge releasably connected to a reusable handle and adapted to be pivotally connected to the handle. The cartridge comprises a housing having at least one razor blade with a sharpened cutting edge disposed therein. Other modern safety razors have a handle and a pivotally connected razor cartridge that are intended to be permanently coupled and disposed of as a single unit. During use, the razor cartridge can pivot relative to the handle about a pivot axis between a neutral, or at-rest, position and a rotated position. The razor cartridge may be adapted to pivot in one direction only away from the neutral position or in two directions. The ability of the razor cartridge to pivot between the neutral and rotated positions relative to the handle is desirable as this enables the razor cartridge and its associated razor blade(s) to maintain optimal contact with the skin surface being shaved during use.

During normal shaving, many forces act on the razor cartridge. These forces primarily include: frictional forces caused by both the skin contacting elements of the housing and the cutting edge of each razor blade passing over the surface being shaved; forces that result when each razor blade cuts hair and reaction forces from the surface being shaved to elements of the housing and each razor blade edge caused by the user pressing the razor against the skin. It will therefore be apparent that the magnitude and direction of the resultant force acting on the razor cartridge, while being dependent upon the number of razor blades disposed within the cartridge housing, is highly variable. The variability is a result of the individual user's skin type; hair type and hair density, as well as the individual user's shaving habits such as how hard the user presses; how well the user prepares the skin with shaving preparation and what particular shaving preparation, if any, is used.

Pivotal razor cartridges generally have a single, defined pivot axis. The magnitude and direction of the resultant force of the many forces acting on the razor cartridge in use, in combination with the spatial position of the pivot axis relative to the skin surface being shaved can cause a moment to be applied to the razor cartridge. A moment is commonly defined as the measure of the tendency to produce motion about an axis and is calculated as the product of the quantity of force and that force's perpendicular distance from the axis. The moment applied to the razor cartridge in use can be beneficial to shaving or can cause undesirable effects. Undesirable effects include chatter or a tendency for the razor cartridge to rotate away from the skin surface during use. Beneficial effects include the razor cartridge maintaining optimal contact with the skin.

Various structures for pivotally connecting a razor cartridge having two or three razor blades to a handle of a safety razor to provide a defined pivot axis are known in the art. In all cases the pivot axis is parallel to the cutting edge or edges of the razor blades. Typical structures are disclosed in GB Patent number 1460732 to Terry et al, U.S. Pat. No. 4,275,498 to Ciaffone, U.S. Pat. No. 4,970,784 to Althaus, U.S. Pat. No. 5,661,907 to Apprille and several patents to Gilder, particularly U.S. Pat. No. 6,612,040.

It is desired to improve the shaving performance of a safety razor by providing four or more razor blades disposed within the cartridge housing as, for example, is disclosed in U.S. patent application Ser. No. 10/782,173 to Coffin. However, simply accommodating a fourth (or further) razor blade in a widened conventional three blade cartridge housing results in a forces being applied to the cartridge during normal shaving that are different from those that are applied to a two or three blade cartridge.

Based on the foregoing, it is the object of the present invention to provide a pivotal connection structure having an optimized pivot axis location for a razor cartridge having at least four razor blades.

SUMMARY OF THE INVENTION

The razor cartridge of a first embodiment of the present invention comprises a housing. The housing may be a single component or may be two or more components permanently joined together. The housing has a guard structure at the front; a cap structure at the rear; a blade mounting means between the guard structure and the cap structure and arcuate bearing surfaces below the housing. The arcuate bearing surfaces slidably engage pivoting connecting structure of a handle, and have constant radii of curvature of between about 4 mm and about 7 mm to provide pivotal mounting on the handle about a pivot axis. The razor cartridge also comprises at least four razor blades disposed in the housing. Each razor blade has a cutting edge. The housing defines a plane tangent to the guard structure and cap structure. The housing also defines a width from the forwardmost point of the guard structure in the vicinity of the plane to the rearwardmost point of the cap structure in the vicinity of the plane. The pivot axis is rearward of the midpoint of the width and on or below the plane that is tangent to the guard structure and the cap structure. The pivot axis may be forward of the cutting edge of the rearwardmost razor blade.

In a further aspect of the present invention, the cap structure has a lubricating strip and the guard structure has an elastomeric portion and a non-elastomeric portion. The elastomeric portion has upwardly extending ribs.

In a still further aspect of the present invention, each razor blade is mounted on a bent support. The support has a support portion and a base portion. The base portion is mounted in respective slots in the housing that are generally perpendicular to the aforementioned tangent plane.

In a second embodiment of the present invention, a safety razor comprises a razor cartridge as previously described, mounted on pivoting connecting structure of a handle. The handle further comprises a grip portion and a spring-biased cam follower and the housing of the razor cartridge further comprises a cam surface. The cam follower acts upon the cam surface to provide the razor cartridge with an at-rest position. The spring-biased cam follower acting upon the cam surface also permits resilient movement of the razor cartridge away from the at-rest position against the spring bias force in response to forces encountered during shaving. The arc of travel of the razor cartridge about the pivot axis is at least 20° and can be in one direction only or both directions away from the at-rest position.

The above features and advantages of the present invention will be more fully understood with reference to the following detailed description when taken in conjunction with the accompanying drawings.

DETAILED DESCRIPTION OF THE INVENTION

Figure 1:
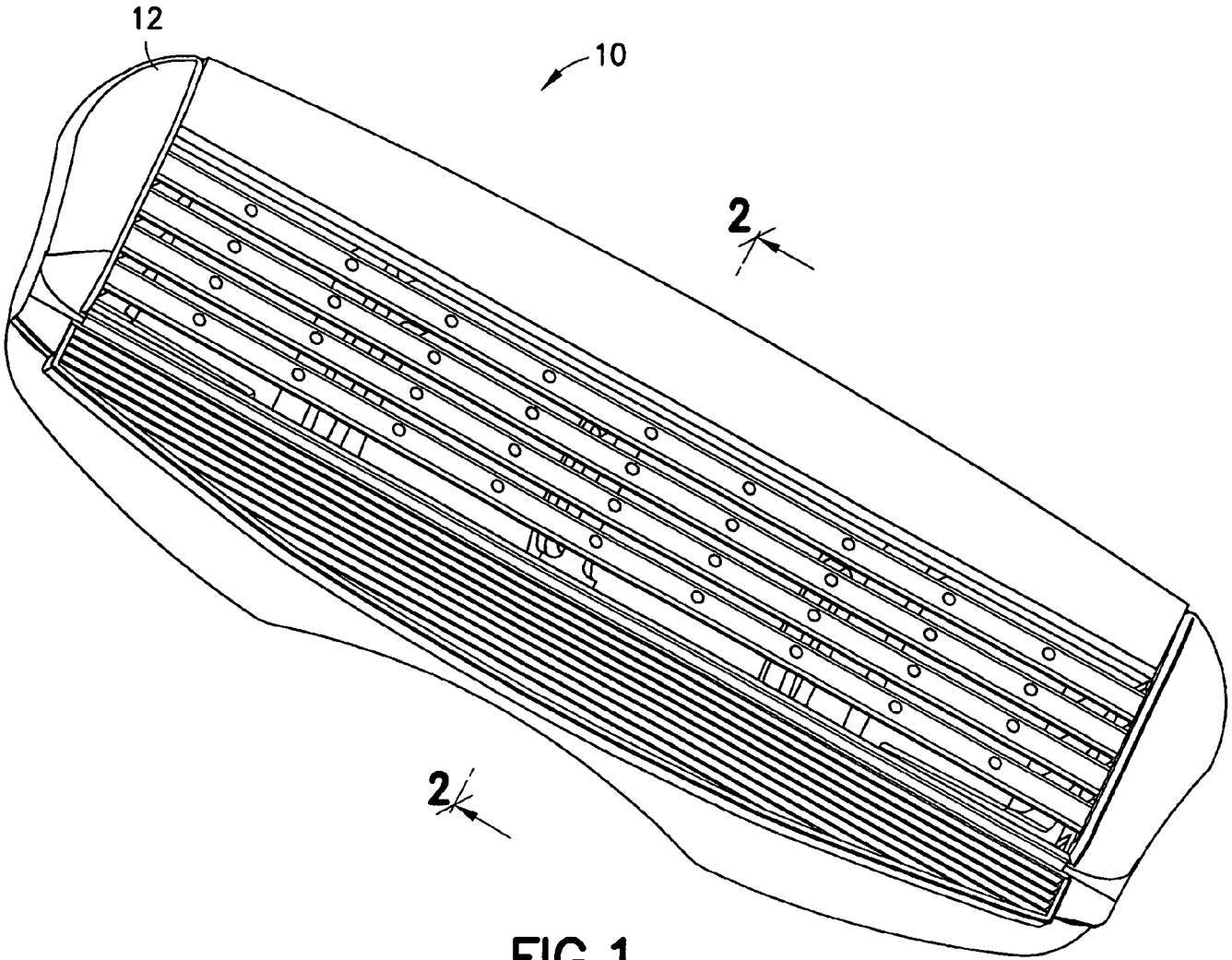
FIG. 1 is an isometric view from the top of the razor cartridge of an embodiment of the present invention.
Figure 2:
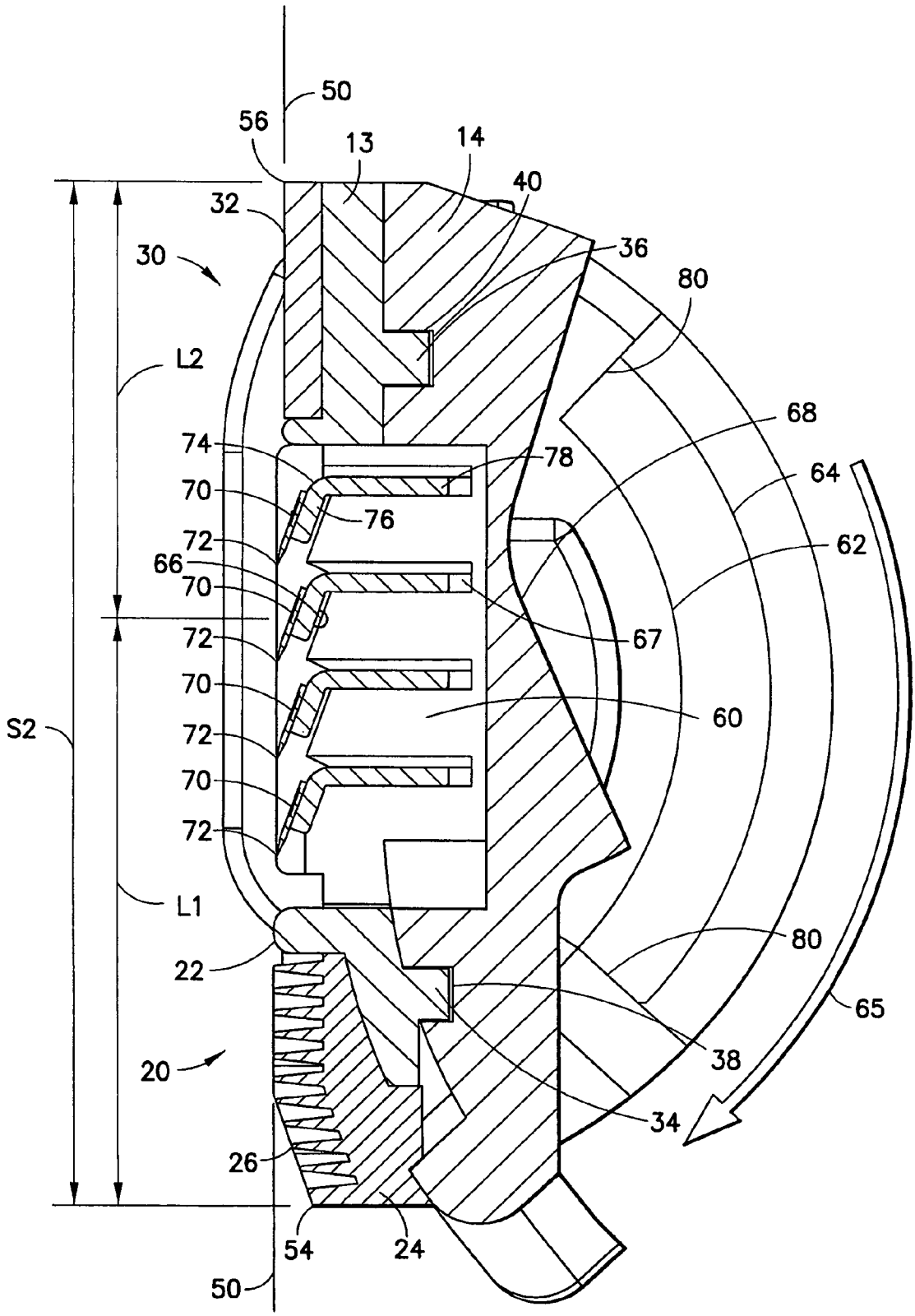
FIG. 2 is a sectional view along line 2-2 of FIG. 1.

Referring now to the drawings and in particular FIG. 1 and 2, a razor cartridge 10, is shown. The cartridge comprises a housing 12 preferably having an upper component 13 and a lower component 14. The upper component and lower component are permanently joined together, preferably by adhesive. Most preferably the adhesive is a cyanoacrylate (CA) adhesive, specifically LOCTITE 401 manufactured by HENKEL. The upper and lower components are preferably injection molded ABS, specifically the material designated HI-10, manufactured by BASF. More particularly the upper component is preferably made by multi-shot injection molding. This specific ABS is selected for properties that include: good compatibility with CA adhesive; good dimensional stability at molding and good impact strength. One of skill in the art will understand other thermoplastic molding materials may also be selected. One of skill in the art will also understand other permanent joining techniques, such as laser welding or ultrasonic welding may be employed. One of skill in the art will further understand the housing may be a single component or more than two components. The upper component of the housing comprises a guard structure 20 which further comprises a rigid, non-elastomeric member 22 and preferably an elastomeric member 24. The elastomeric member preferably comprises one or more fins 26 as is well known in the art and is provided to stimulate the skin of the user. The material of the elastomeric member is preferably THERMOPLAST TF4AXX manufactured by KRAIBURG. The upper component of the housing also comprises a cap structure 30. The cap structure preferably has a lubricating strip 32. The materials and methods of manufacture and assembly of lubricating strips are also well known in the art. The upper component further comprises ribs 34, 36 which extend from the mating surface. These ribs are inserted into respective recesses 38, 40 in the lower component to provide accurate alignment of the upper and lower components at assembly. The upper component of the housing defines a plane 50 tangent to both the guard structure and cap structure. The upper component also defines a width S2 from the forwardmost part of the guard structure in the vicinity of the plane 54, to the rearwardmost part of the cap structure in the vicinity of the plane 56.

The lower component of the housing comprises a blade mounting region 60. The lower component also comprises coaxial inner and outer arcuate bearing surfaces 62 and 64 respectively, of constant radius and having center 66. Center 66 is preferably on or below plane 50 tangent to both the guard structure and cap structure. Center 66 provides the pivot axis of the razor cartridge, when the cartridge is mounted on the pivoting connecting structure of a handle. The radius of the inner arcuate surface 62 is preferably about 4-6 mm and most preferably 5 mm. The radius of the outer arcuate surface 64 is preferably about 5-7 mm and most preferably 6 mm. The lower component further comprises cam surface 68. The distance from the pivot axis 66 to the forwardmost point of the guard structure 20, defined parallel to plane 50 is defined as L1. The distance from the pivot axis 66 to the rearwardmost point of the cap structure 30, defined parallel to plane 50 is defined as L2. L1 is preferably greater than L2, that is, pivot axis 66 is rearward of the midpoint of width S2. Pivot axis 66 may also be forward of the cutting edge 72 of the rearwardmost razor blade 70.

With the pivot axis thus positioned, the moment created by the resultant of the many forces acting on the razor cartridge during normal shaving acts in a clockwise direction as viewed in FIG. 2, as shown by arrow 65. This maintains optimal contact of the skin stimulating guard structure and at least the two forwardmost razor blades with the skin surface being shaved. In addition, reaction forces acting normal to the skin surface and applied to the elements of the razor cartridge that are rearward of the pivot axis 66 act to balance this moment to maintain optimal skin contact when the razor cartridge travels over relatively highly non-planar surfaces, such as the chin line of a male user or the knees or ankles of a female user.

At least 4 razor blades 70 are mounted in the housing. The razor blades have sharpened cutting edges 72 and are mounted on bent supports 74 in the depicted embodiment. The supports have a support portion 76 and a base portion 78. The base portions 78 of the supports 74 are mounted in respective slots 67 of the lower component of the housing. In further embodiments the bent supports may be omitted and alternative means for mounting the razor blades within the housing may be employed. Alternative means for mounting blades within the housing may include: using adhesive to secure the blades as is disclosed in U.S. Pat. No. 5,481,802 to Lembke; insert molding the blades within the housing as is disclosed in U.S. Pat. No. 5,141,694 to Butlin et al; mounting the blades on an intermediate blade carrier component that is then mounted within the housing as is disclosed in U.S. patent application Ser. No. 10/765,549 or mounting the blades on posts that project from the Cap as is disclosed in U.S. Pat. No. 3,724,070 to Dorion or that project from the Guard. The means for mounting the blades within the housing is well known to one of skill in the art.

Figure 3:
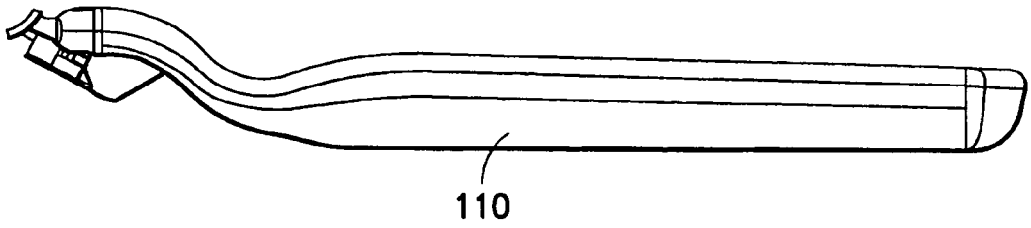
FIG. 3 is a side view of the handle of an embodiment of the present invention.
Figure 3A:
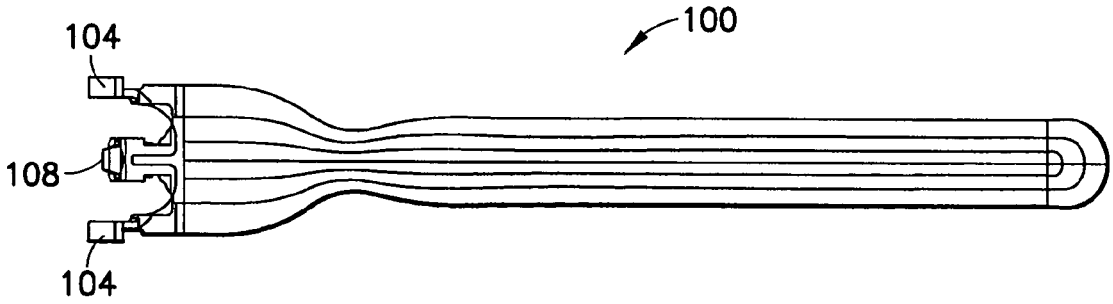
FIG. 3A is an underside view of the handle of an embodiment of the present invention.
Figure 3B:
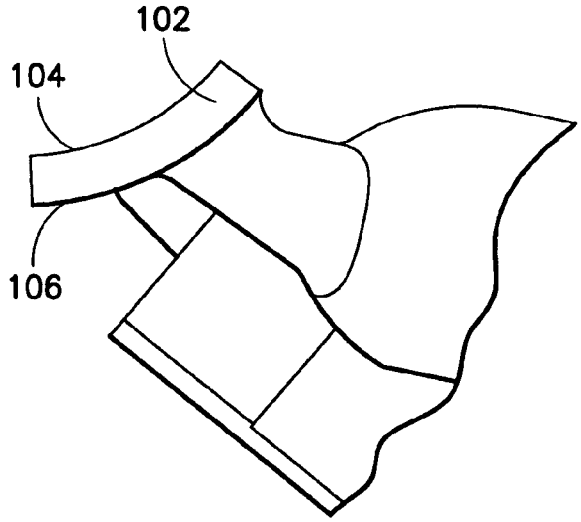
FIG. 3B is an enlarged view of a part of FIG. 3.

Referring additionally now to FIGS. 3, 3A and 3B, a side view of a handle 100 having pivoting connecting structure 102 is shown. The pivoting connecting structure has inner and outer arcuate bearing surfaces, 104 and 106 respectively, that slidably engage the arcuate bearing surfaces of the razor cartridge 62, 64 to provide pivotal mounting of the razor cartridge. The handle also comprises a spring biased cam-follower 108. When the razor cartridge is mounted on the handle the cam follower 108 engages the cam surface 68 of the housing to provide the razor cartridge an at-rest position and to permit resilient movement of the razor cartridge away from the at-rest position against spring bias force of the cam follower in response to forces encountered during shaving.

The lower component of the housing further comprises forward and rearward stop surfaces 80. The stop surfaces interact with the pivoting connecting structure of the handle to limit the arc of travel of the razor cartridge. The arc of travel is preferably at least 20° and most preferably about 40°. The cam follower and cam surface may be adapted to provide resilient pivotal movement of the razor cartridge in one direction only from the at-rest position in response to forces encountered during shaving. Most preferably the pivotal movement is in a rearward direction, that is clockwise as viewed in FIG. 2. The cam follower and cam surface may alternately be adapted to provide pivotal movement in both forward and rearward directions from the at-rest position in response to forces encountered during shaving. In this alternative the at-rest position is preferably not in the mid position of the arc of travel and preferably the range of rearward pivoting is greater than the range of forward pivoting. Referring to FIG. 2, forward pivoting is counterclockwise as seen in this figure.

The handle also has a grip portion 110.

Figure 4:
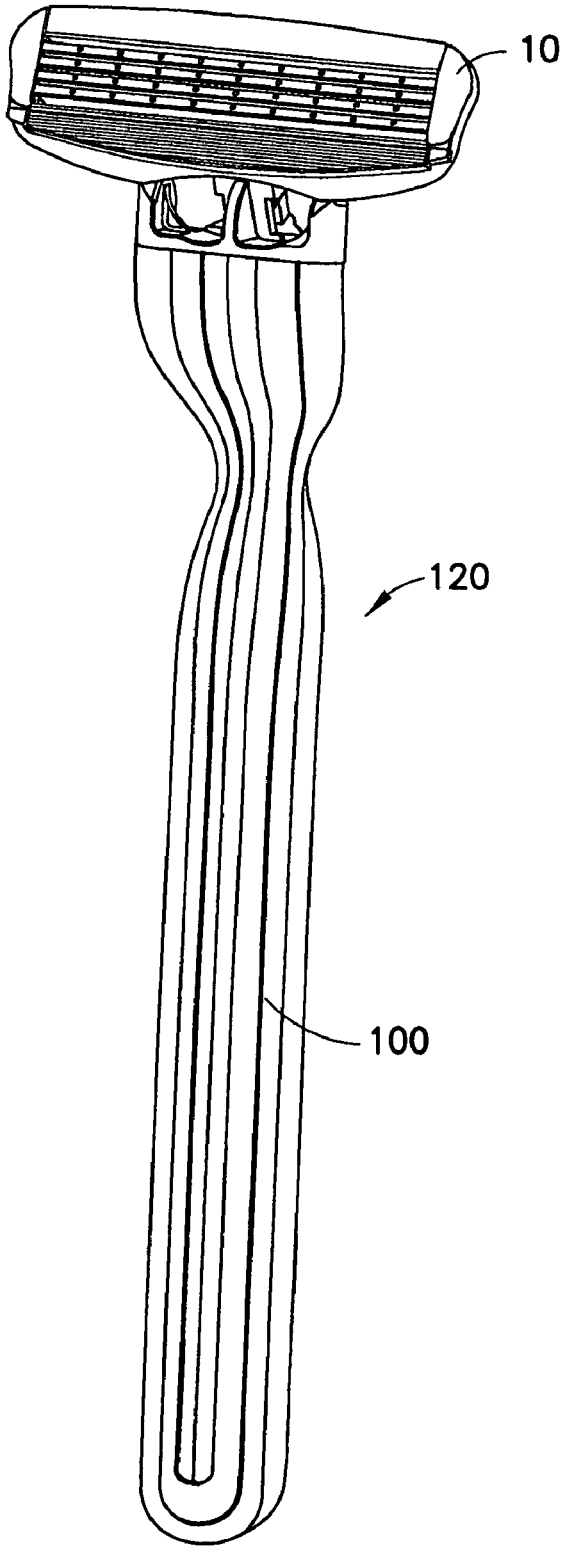
FIG. 4 is an isometric view from the front of the safety razor of an embodiment of the present invention.

Referring now to FIG. 4, a safety razor 120 is shown, comprising a razor cartridge 10 as previously described mounted on pivoting connecting structure of a handle 100, also as previously described.

It is to be understood that the present invention is by no means limited to the particular construction herein disclosed and/or shown in the drawings, but also comprises any modifications or equivalents within the scope of the disclosure.

What is claimed is:

1. A razor cartridge, comprising:

a housing having: a guard structure at the front thereof, a cap structure at the rear thereof, blade mounting means between the guard structure and the cap structure; arcuate bearing surfaces below the housing that slidably engage pivoting connecting structure of a handle, have radii of curvature to provide pivotal mounting on the handle about a pivot axis, and at lease four razor blades, each razor blade having a cutting edge, wherein the housing defines a plane tangent to the guard structure and the cap structure, wherein the housing defines a width from the forwardmost point of the guard structure in the vicinity of the plane to the rearwardmost point of the cap structure in the vicinity of the plane, and wherein the pivot axis is rearward of the midpoint of the width and below both the plane that is tangent to the guard structure and the cap structure and the cutting edges of the at least four razor blades.

2. A razor cartridge according to claim 1, wherein the pivot axis is forward of the cutting edge of the rearwardmost razor blade.

3. A razor cartridge according to claim 1, wherein the arcuate bearing surfaces have a constant radius of curvature.

4. A razor cartridge according to claim 3, wherein the arcuate bearing surfaces have radii of curvature less than about 7 mm.

5. A razor cartridge according to claim 3, wherein the arcuate bearing surfaces have radii of curvature greater than about 4 mm.

6. A razor according to claim 1, wherein the guard structure comprises an elastomeric portion and a non-elastomeric and the elastomeric portion has upwardly extending ribs.

7. A razor according to claim 1, wherein the blade mounting means further comprises a bent support, the support having a support portion and a base portion.

8. A razor according to claim 7, wherein the base portion is generally perpendicular to the plane.

9. A razor according to claim 8, wherein the base portion is mounted in a slot in the housing, the slot being generally perpendicular to the plane.

10. A razor cartridge according to claim 1, wherein the housing comprises an upper component and a lower component.

11. A razor cartridge according to claim 10, wherein the upper component and the lower component are permanently joined.

12. A razor cartridge according to claim 11, wherein the permanent joining is by adhesive.

13. A razor cartridge according to claim 11, wherein the permanent joining is by welding.

14. A safety razor, comprising:

a handle having a grip portion and a handle pivoting connecting structure, and a razor cartridge comprising a housing having a guard structure at the front thereof, a cap structure at the rear thereof, the cap structure having a lubricating strip, a blade mounting portion between the guard structure and the cap structure, arcuate bearing surfaces below the housing that slidably engage the handle pivoting connecting structure and have radii of curvature to provide pivotal mounting on the handle about a pivot axis, and at least four razor blades disposed in the blade mounting portion, each razor blade having a cutting edge, wherein the housing defines a plane tangent to the guard structure and the cap structure, wherein the housing defines a width from the forwardmost point of the guard structure in the vicinity of the plane to the rearwardmost point of the cap structure in the vicinity of the plane, and wherein the pivot axis is rearward of the midpoint of the width and below the plane that is tangent to the guard structure and the cap structure and below the cutting edges of the at least four blades.

15. A safety razor according to claim 14, wherein the pivot axis is forward of the cutting edge of the rearwardmost razor blade.

16. A safety razor according to claim 14, wherein the handle further comprises a spring-biased cam follower and the housing of the razor cartridge further comprises a cam surface, wherein the cam follower acts upon the cam surface to provide the razor cartridge at-rest position and to permit resilient movement of the razor cartridge away from the at-rest position against spring bias force of the cam follower in response to forces encountered during shaving.

17. A razor cartridge according to claim 16, wherein the razor cartridge can rotate through an arc of travel of at least about 20° about the pivot axis.

18. A safety razor according to claim 17, wherein the housing has stop surfaces that interact with the pivoting connecting structure of the handle to provide forward and rearward pivot stop positions.

19. A safety razor according to claim 16, wherein the razor cartridge is adapted for pivotal movement in one direction only from the at-rest position about the pivot axis.

20. A safety razor according to claim 16, wherein the razor cartridge is adapted for pivotal movement in both a forward or rearward direction from the at-rest position about the pivot axis and wherein the at-rest position is not in the mid position of the arc of travel.

21. A safety razor according to claim 20, wherein the amount of rearward pivoting is greater than the amount of forward pivoting.

* * * * *